US005416455A

United States Patent [19]

Moldovan et al.

[11] Patent Number: 5,416,455

[45] Date of Patent: May 16, 1995

[54] DIRECT CURRENT SWITCHING APPARATUS

[75] Inventors: Peter K. Moldovan, Cascade; Earl T. Piber, Oconomowoc; Peter J. McGinnis, Brookfield; Peter J. Theisen, West Bend; Jeffery A. Patten, Lake Mills, all of Wis.

[73] Assignee: Eaton Corporation, Cleveland, Ohio

[21] Appl. No.: 200,974

[22] Filed: Feb. 24, 1994

[51] Int. Cl.[6] ..... H01H 67/02

[52] U.S. Cl. ..... 335/132; 335/202; 218/1

[58] Field of Search ..... 335/16, 147, 195, 131, 335/132, 202, 201; 200/144 R, 147 R

[56] References Cited

U.S. PATENT DOCUMENTS 4,800,352 1/1989 Haury et al. ..... 335/132
5,004,874 4/1991 Theisen et al. ..... 200/144 R
5,130,504 7/1992 Moldovan et al. ..... 200/147 R
5,138,122 8/1992 Moldovan et al. ..... 200/144 R
5,163,175 11/1992 Mori et al. ..... 335/132
5,235,303 8/1993 Xiao ..... 335/132

*Primary Examiner*—Lincoln Donovan

[57] ABSTRACT

A two-pole switch for DC current has a housing formed by a pair of open shells abutting each other to enclose components of the apparatus. Each shell rigidly holds a stationary contact, and an actuator is pivotally coupled to the shells. A pair of movable contacts are pivotally attached to the actuator so that each movable contact touches one stationary contact when the actuator is in a first position and the contacts are separated when the actuator is in a second position. A spine plate is between the shells and electrically separates the two stationary contacts and arc extinguishing chambers. A solenoid is within the housing aligned with the contacts and drives the actuator between the second and first positions to close the contacts.

27 Claims, 4 Drawing Sheets

DIRECT CURRENT SWITCHING APPARATUS

BACKGROUND OF THE INVENTION

This invention relates to apparatus for switching direct current (DC) electric power, and more particularly to such apparatus which is polarized yet bi-directional, i.e. it can switch current with either polarity, but its performance is better with one polarity of the current than with the other polarity.

DC power has been proposed for electrically powered vehicles in which the electricity is derived from a bank of storage batteries or other DC power source. In electric automobiles, a switch is provided between the DC power source and an electric motor, which drives the wheels of the vehicle. Weight, reliability and high DC voltage switching and interrupting capability are important considerations in developing the switching apparatus. Furthermore, relatively high direct currents must be switched which produce arcs when the contacts of the switch are opened, thereby requiring a mechanism for extinguishing the arcs.

Although current conducts in one direction between the source and the electric motor when the electric motors are driving the wheels, electrically powered vehicles also have a regeneration mode in which the current conducts in the opposite direction when the wheels are not being driven by the motor. Thus, the switch between the DC power source and the motor must be capable of handling switching and fault currents in both directions at high DC voltage and extinguishing arcs which may occur regardless of the direction of that current.

SUMMARY OF THE INVENTION

A general object of the present invention is to provide an improved DC switching apparatus which can switch current regardless of the direction through the apparatus.

Another object is to provide such a light weight and reliable switching apparatus that is particularly adapted for use in electrically powered vehicles.

A further object is to perform the switching without any arc by-products, such as flames, extending beyond the enclosure of the apparatus.

These objects are fulfilled by a polarized bi-directional direct current switching apparatus that includes a housing formed by first and second shells each having an open side with the open side of the first shell abutting the open side of the second shell. A first stationary contact is rigidly held in the first shell and the second stationary contact is rigidly held in the second shell. A separate pair of arc extinguishing chambers are within each shell and are spaced apart on opposite sides of the stationary contact in the respective shell. A molded plate of insulating material, referred to as a spine, is between the first and second shells to separate electrically the stationary contacts and associated arc extinguishing chambers. The spine also acts to hold the stationary contacts in a fixed position by pressing them into receptors in the shells, thus preventing movement of the contacts during operation of the apparatus.

An actuator of insulting material is coupled to the first and second shells in a manner that allows the actuator to pivot between first and second positions within the housing. First and second movable contacts are attached to the actuator so that the movable contacts touch a respective stationary contact when the actuator is in the first position and are remote from the stationary contacts when the actuator) is in the second position. A solenoid is located within the housing and has an armature connected to pivot the actuator.

In the preferred embodiment of the direct current switching apparatus, a separate permanent magnet structure encircles each pair of arc extinguishing chambers. The permanent magnet structure provides a magnetic field that propels any arc that exists between the stationary and movable contacts into an arc extinguishing chamber. Each permanent magnet structure includes two permanent magnets spaced from each other with a magnetic field spreader in contact with and extending between the permanent magnets. A first C-shaped pole piece has a first end in contact with one permanent magnet and a second C-shaped pole piece has a first end in contact with the other permanent magnet. The first and second C-shaped pole piece have other ends in abutment.

DETAILED DESCRIPTION OF THE INVENTION

Figure 1:
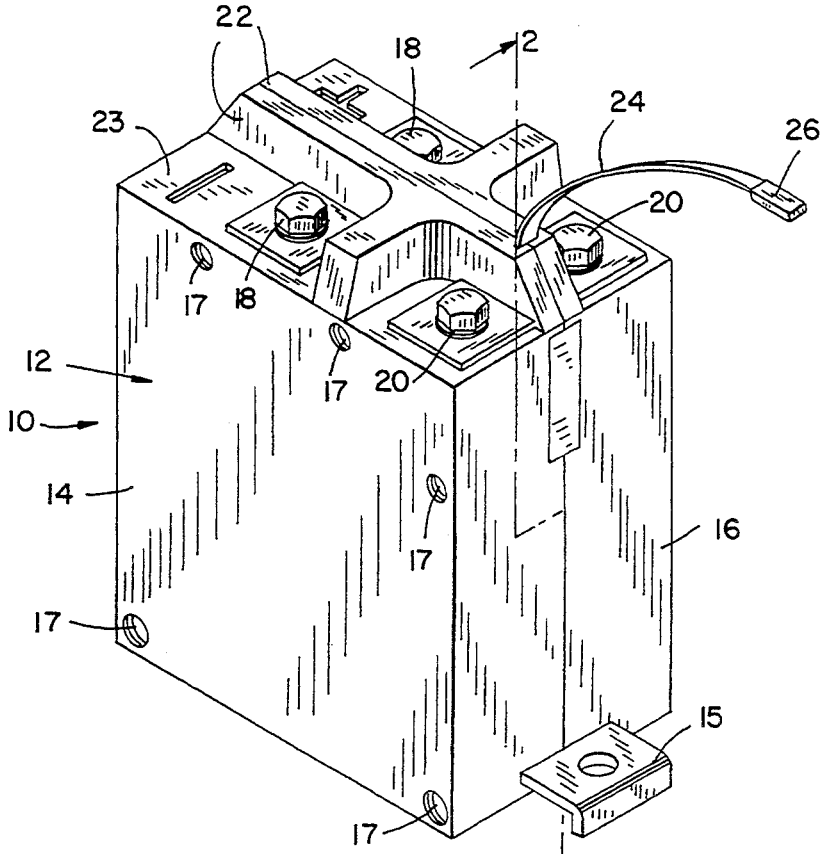
FIG. 1 is an isometric view of a switching apparatus according to the present invention.

With reference to FIG. 1, a sealed electromagnetic two-pole switching apparatus 10 has a plastic housing 12 formed by two substantially mirror image shells 14 and 16 formed of plastic material. The shells are held together by five rivets 17 to encapsulate a polarized, bi-directional DC switch mechanism within the housing. Separate L-shaped mounting brackets 15 are located on opposite sides of the housing 12. These brackets have an aperture therethrough for receiving a bolt to attach the housing 12 to a suitable mounting surface.

Each shell 14 and 16 has a primary power terminal 18 and a secondary power terminal 20 and encloses one pole of the two-pole switch mechanism within a chamber of the shell. In a typical electrically powered vehicle, the cables leading from a DC power source connect to the primary terminals 18 and the secondary terminals 20 are coupled to components that control the vehicle's motor. With such connection, direct current conducts from the primary terminal 18 to the secondary terminal 20 of shell 16 and from the secondary terminal 20 to the primary terminal 18 of shell 16, when the DC power source is powering the motor. In the regeneration mode of operation for the vehicle, the DC current conducts in the opposite direction. Exterior walls 22 are upstanding from the top wall 23 of the housing 12 to provide electrical isolation between adjacent terminals 18 and 20.

A multi-conductor cable 24 extends from the upper portion of the housing 12 and has a multiple pin connector 26 at its remote end. As will be described, the conductors in cable 24 connect to a solenoid coil and an auxiliary switch within the housing.

Figure 2:
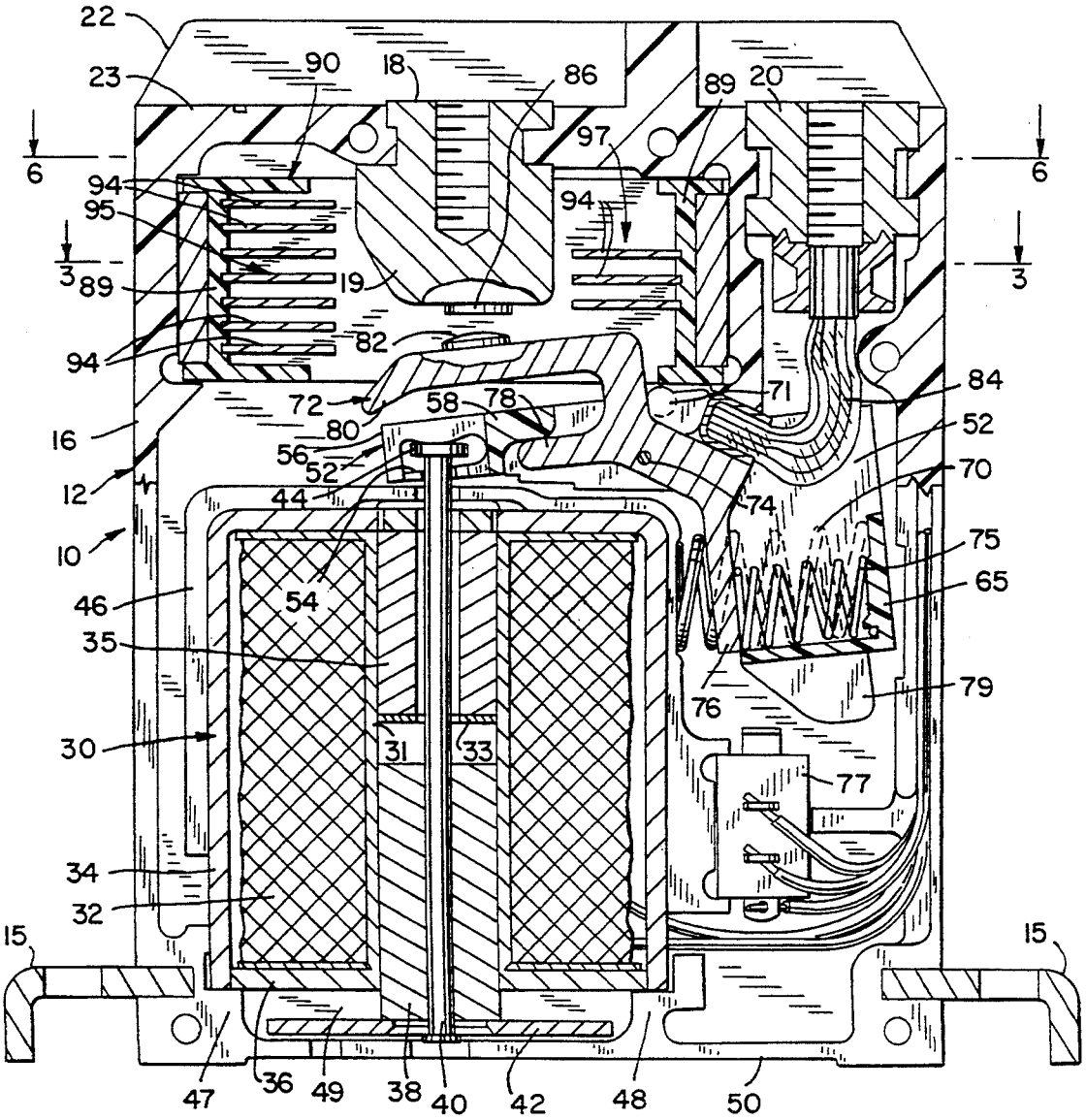
FIG. 2 is a cross sectional view along line 2—2 of FIG. 1.

With reference to FIG. 2, the switching apparatus 10 includes an electromagnetic solenoid 30 having an annular coil 32 within a U-shaped metal frame 34 which is closed by a metallic end plate 36. The coil 32 has a central opening with a non-magnetic sleeve 31. An armature is located within the coil's central opening and comprises a metallic plunger 38 attached along with a disk 42 to one end of pin 40. The plunger 38 is located in the lower portion of the sleeve 31 and has a length approximately equal to one-half the length of the central opening. A magnetic core 35 is fixedly positioned in the upper portion of sleeve 31 and has a non-magnetic washer 33 affixed to an end that is proximate to the plunger 38. The sleeve 31 and the washer 33 prevent magnetic sticking of the plunger 38. The pin 40 projects from the solenoid 30 and through an aperture in the frame 34 and terminates with head 44 at the remote end. Wires from the solenoid coil 32 connect to cable 24 shown in FIG. 1.

The solenoid 30 nests within a housing chamber that is defined by an inverted U-shaped internal wall 46 of each shell 14 and 16. The solenoid frame 34 abuts the inside surface of wall 46 and rests on platforms 47 and 48 which extend inwardly from the bottom wall 50 of each shell 14 and 16. The platforms 47 and 48 space the solenoid 30 from the bottom wall providing a cavity 49 within which the plunger disk 42 is located and permitted to move.

Figure 4:
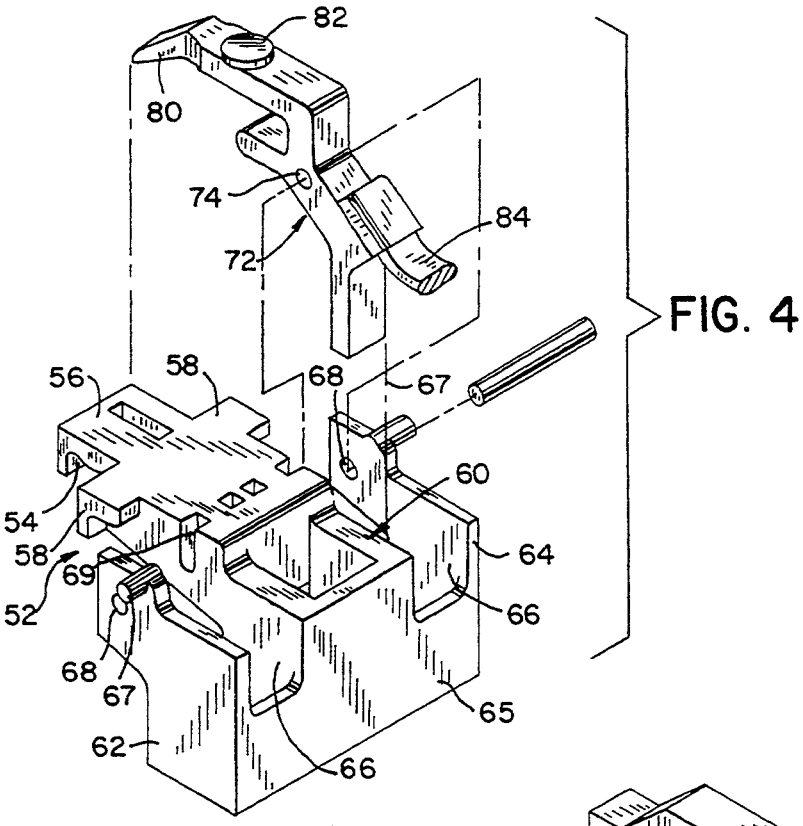
FIG. 4 is an isometric, exploded view of a contact actuator and contactor shown in FIG. 2.

The head 44 of the solenoid pin 40 engages a contact actuator 52 formed of an electrically insulating material, such as plastic. The details of the contact actuator 52 are shown in FIG. 4. Specifically, the head 44 of the solenoid pin 40 is captured within a T-shaped slot 54 in an arm 56 of the actuator 52. The slot 54 has a convex crowned upper surface which facilitates movement of the pin head 44 within the slot 54 as will be described. A pair of wings 58 project from opposite sides of the arm 56 and into each shell 14 and 16 when the actuator is assembled into the housing 12. Arm 56 extends from a box-like central section 60 which is open on top and on the side from which arm 56 extends. Separate side walls 62 and 64 are spaced from and located on either side of the central section 60 in planes which are generally parallel to the longitudinal axis of the arm 56. The side walls 62 and 64 create channels 66 between the respective wall and the central section 60 of the actuator 52. Projecting outwardly from each side wall 62 and 64 is a separate round trunion 67. A hole 68 extends through each side wall 62 and 64 and is aligned with a recessed hole 69 in the sides of arm 56. The actuator 52 has a transverse end wall 65 which forms part of the wall of the central section 60 and extends to each of the side walls 62 and 64.

Referring still to FIGS. 2 and 4, the actuator 52 is positioned within the housing 12 so that the trunions 67 are received in holes in each shell 14 and 16 allowing the actuator to pivot in response to movement of the solenoid pin 40. A first spring 70 is positioned within the central section 60 of the actuator 52 extending between the inner surface of end wall 65 of the actuator and a surface of the U-shaped internal wall 46 of the shells 14 and 16. The first spring 70 biases the actuator 52 counterclockwise in FIG. 2 to force the solenoid pin 40 and its attached plunger 38 and disk 42 downward until the end of the solenoid pin abuts bottom wall 50 of the housing 12. The first spring 70 opposes the force of the electromagnetic field produced by solenoid coil 32 and places the switch mechanism in the illustrated position when electricity is not being applied to the coil.

A separate metal contactor 72 is located within each of the channels 66 on each side of the actuator 52 and is held in place by a pin 74 which is received in apertures 68 and 69 of the actuator. Each contactor 72 is able to pivot about the pin 74 with respect to the actuator. A separate second spring 75 extends between a lower arm 76 of each contactor 72 and the interior of actuator wall 65 within each channel 66 of the actuator 52. Each second spring 75 biases the associated contactor 72 clockwise in FIG. 2 with respect to the actuator. In the deenergized state of the solenoid 30, the second springs 75 bias the contactors 72 so that contactor tabs 78 abut the lower surface of the associated wing 58 on the actuator 52, thereby limiting the clockwise travel of the contactors. This allows for preloading of the contactors 72 and sets up conditions which produce hammer-blow action through interaction of the contactor tabs 78 with the actuator wings 58 during a contact weld condition. All of the springs 65 and 75 are located remote from arc extinguishing chambers 95 and 97 so that arcs generated by the operation of the switching apparatus 10 can not reach the springs which could be damaged by repeated arc contact.

Each secondary terminal 20 has a separate copper braid 84 bonded to it and the other end of the copper braid is attached to the central portion of an adjacent contactor 72. An elongated upper arm 80 of the contactor 72 extends parallel to the upper surface of arm 56 on the actuator 52 and contains an electrical contact member 82 on its upper surface to form a movable contact. The remote tip of the upper arm 80 is tapered to a reduced width, thereby allowing arc gases to flow around the tip without impeding the movement of the arc.

The primary terminal 18 in each shell 14 and 16 is integral with a stationary contact 19. Each stationary contact 19 has a lower surface on which a contact element 86 is located in a position opposed to the contact element 82 on the contactor 72.

When the solenoid coil 32 is energized, the magnetic field drives the plunger 38 and attached pin 40 upward through the solenoid coil. This movement causes the head 44 of the pin 40 to push the arm 56 of actuator 52 upward, pivoting the actuator about trunions 67 and compressing the first spring 70. The pivoting of the actuator 52 also causes the upper arm 80 of each contactor 72 to move upward so that its contact element 82 strikes the contact element 86 of stationary contact 19. Once contact elements 82 and 86 engage, further pivoting of the actuator 52 results in compression of the corresponding second spring 75 which exerts further force against the contactor 72 to maintain the contacts closed and compensates for electrical erosion and mechanical wear. Because the actuator 52 and contactor 72 pivot about different axes, lateral movement occurs between their contact elements 82 and 86 respectively, which wipes oxidation from the contact elements.

The solenoid armature is substantially aligned with contact elements 82 and 86 (i.e. These components substantially lie in a common plane). Thus pin 40 of the solenoid armature applies substantially in-line force to and moves in the same direction and plane as the movement between the movable and stationary contact elements 82 and 86. In addition, the pivot axis 71 (FIG. 2) of the actuator 52 is nearly horizontally aligned with the movable contact elements 82 to provide substantially vertical movement and significant opening velocity to enhance speed of DC switching between the contact elements 82 and 86. As a result of these alignments, the driving force provided by the solenoid 30 is efficiently transferred to the closing action of the contacts with some contact wipe still present. The disk 42 on the armature assembly of the solenoid also enhances the holding force of the solenoid, enabling less holding force to be exerted by the movement mechanism in order to hold the contacts closed and thus provide more efficient operation for the size and power of the solenoid.

An auxiliary snap-action push button switch 77 is held within a notch in the internal wall 46 of each shell and is activated by a cam 79 on the bottom of the actuator 52 when the contacts are in a closed state. Wires from cable 24 connect to the auxiliary switch 77.

Referring to FIG. 2, arcs are created as the contact elements 82 and 86 open, when the switching apparatus 10 is utilized to switch relatively large electric currents. The contactor 72 is designed so that the current will be conducted from the braid 84 to contact element 82 along the direction indicated by the arrow when the current conducts from the primary terminal 18 to the secondary terminal 20. This direction of current conduction in the upper arm 80 of contactor 72 creates a magnetic field about the upper contactor arm 80 which field interacts with the arc between the contact elements 82 and 86 to assist arc movement toward the tip of the upper arm 80.

Figure 3:
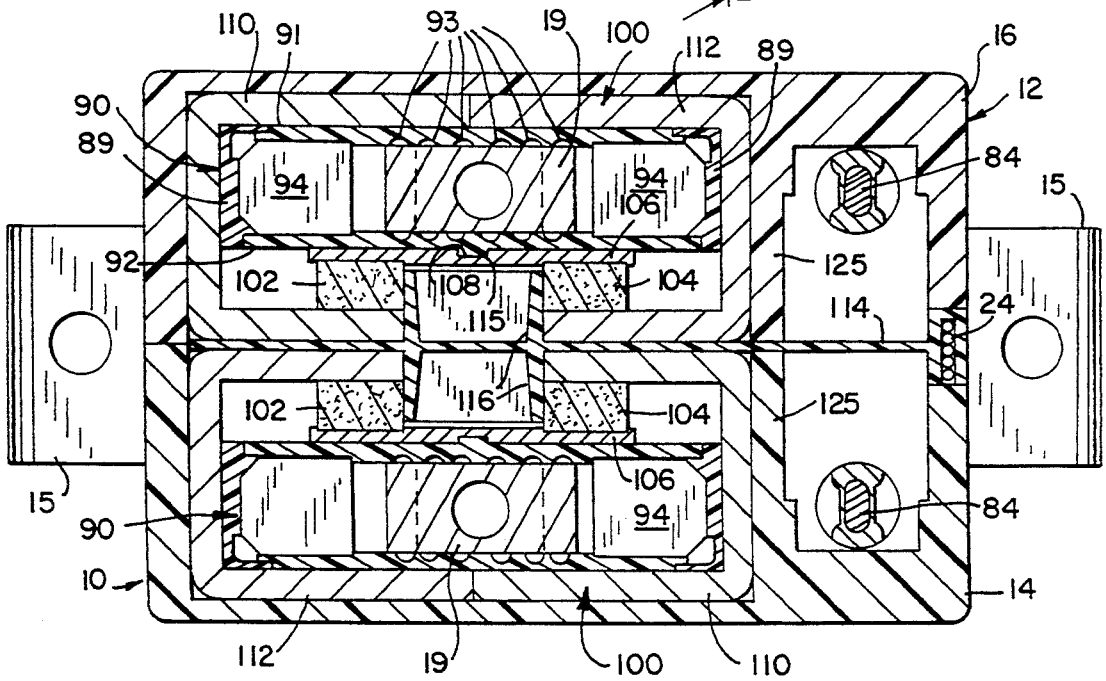
FIG. 3 is a cross sectional view along line 3—3 of FIG. 2.

The upper arm 80 of the contactor 72 and the stationary contact 19 extend into the central opening of an arc chute assembly 90 in each shell 14 and 16. Each arc chute assembly has a rectangular enclosure with openings in the top and bottom to receive the stationary contact 19 and the contactor 72, respectively. Referring to FIGS. 2 and 3, each arc chute enclosure is formed of electrically insulating material and has outer and inner side walls 91 and 92, respectively with end caps 89 extending between the side walls to close openings in the ends of the enclosure. The inside surface of the central portion of each side wall 91 and 92 has a number of vertical grooves 93 which form vents alongside each stationary contact 19 through which arc gases can pass. The interior surface of the end sections of each side wall 91 and 92 have a plurality of horizontal grooves cut therein for receiving metallic splitter plates 94 which form separate arc extinguishing chambers 95 and 97 at the ends of the assembly 90. As shown in FIG. 2, the arc extinguishing chamber 95 which is adjacent the remote end of the upper arm 80 of contactor 72 has seven sloitter plates 94 located in the slots of the arc chute enclosure, while arc extinguishing chamber 97 which is proximate to the other end of the upper arm 80 has only three slitter plates. The reason for this difference in the number of slitter plates 94 in the two arc extinguishing chambers 95 and 97 will be described subsequently.

Each arc chute assembly 90 is located within a separate permanent magnet structure 100 that includes two rare earth permanent magnets 102 and 104 spaced from one another. A magnetic spreader 106 abuts each permanent magnet 102 and 104 spanning the gap therebetween. The surface of the spreader 106 which abuts the two permanent magnets 102 and 104 has recesses therein which receive one side of the permanent magnets to rigidly orient and hold the magnets with respect to each other. The opposite surface of the spreader 106 has a central aperture 108. The spreader plate allows smaller permanent magnets to be used in the present structure.

Two C-shaped pole pieces 110 and 112 also form part of each permanent magnet structure 100. One end of each C-shaped pole piece 110 and 112 contact the surface of a permanent magnet 102 or 104, while the other ends of each pole piece abut one another. The C-shape of the pole pieces 110 and 112 form an internal cavity in which the arc chute assembly 90 is received. The outer surface of wall 92 of the arc chute assembly 90 has a boss 115 that fits within aperture 108 in spreader 106 to interlock the components restricting the vertical movement of the arc chute assembly 90 and positioning the arc chute assembly relative to magnet assembly 100.

During fabrication, the side walls 91 and 92, splitter plates 94 and the end caps 89 of an arc chute assembly 90 are fitted together. The permanent magnets 102 and 104 and spreader are fitted together and interlocked with the arc chute assembly 90. The two C-shaped pole pieces 110 and 112 are placed around the assembled combination which then is placed within a strong electric coil to magnetize the rare earth magnets 102 and 104. Once magnetized, the permanent magnets produce a magnetic field through the pole pieces 110 and 112 and which magnetically holds the assembled combination together without the need for other fastening mechanisms.

Figure 5:
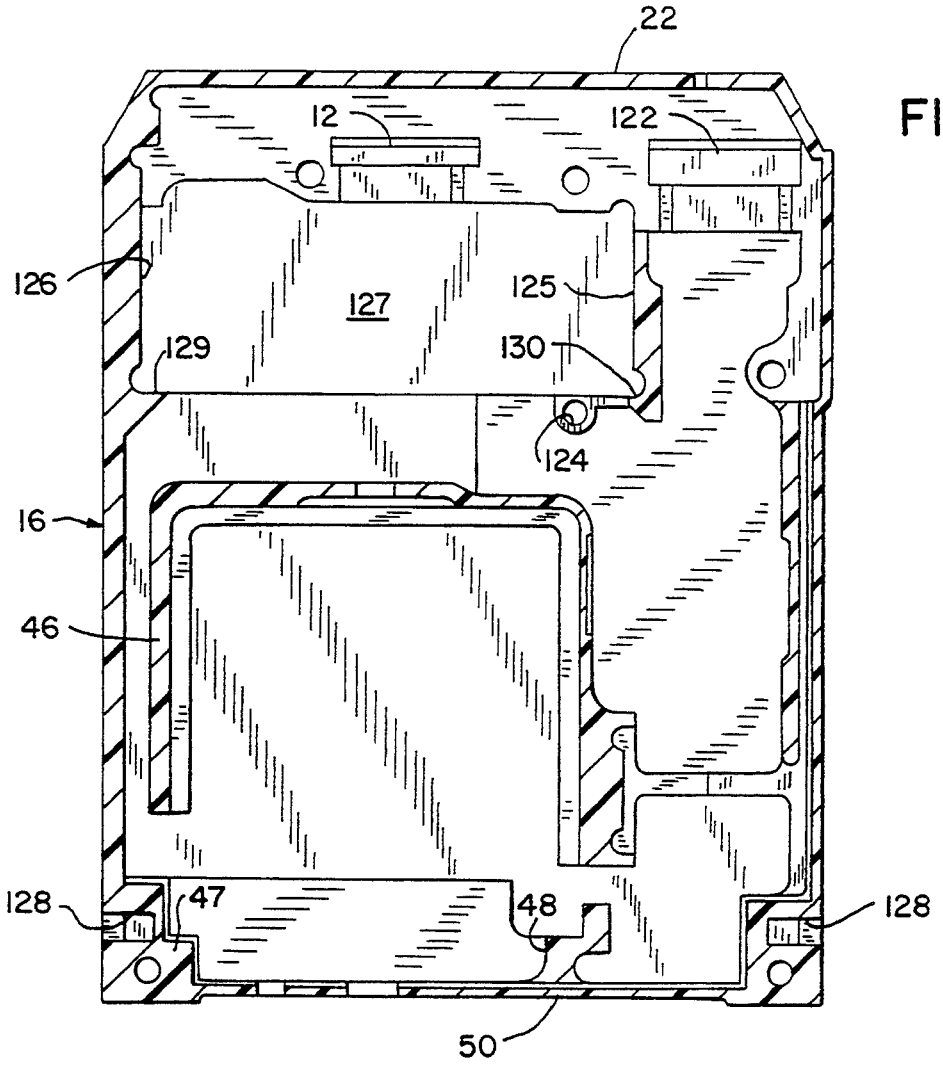
FIG. 5 is a partial cross section view through one half of the housing for the switching apparatus.

The combination of an arc chute 90 assembly and magnet structure 100 then is placed within each of the two housing shells 14 and 16. The shells 14 and 16 have walls and recesses that form interior surfaces for holding components of the switching apparatus. The interior surfaces of housing shell 16 are shown in FIG. 5 and the interior surfaces of the other shell 14 are substantially a mirror image of the surfaces illustrated. A vertical interior wall 125 and side wall 126 define a cavity 127 for containing the combination of the arc chute assembly 90 and permanent magnet structure 100. Horizontal tabs 129 and 130 also locate that combination within each shell 14 and 16. The locations of the interior wall 125 and tabs 129 are closely toleranced so that the arc chute assembly 90 and permanent magnet structure 100 are firmly held in cavity 127.

Figure 6:
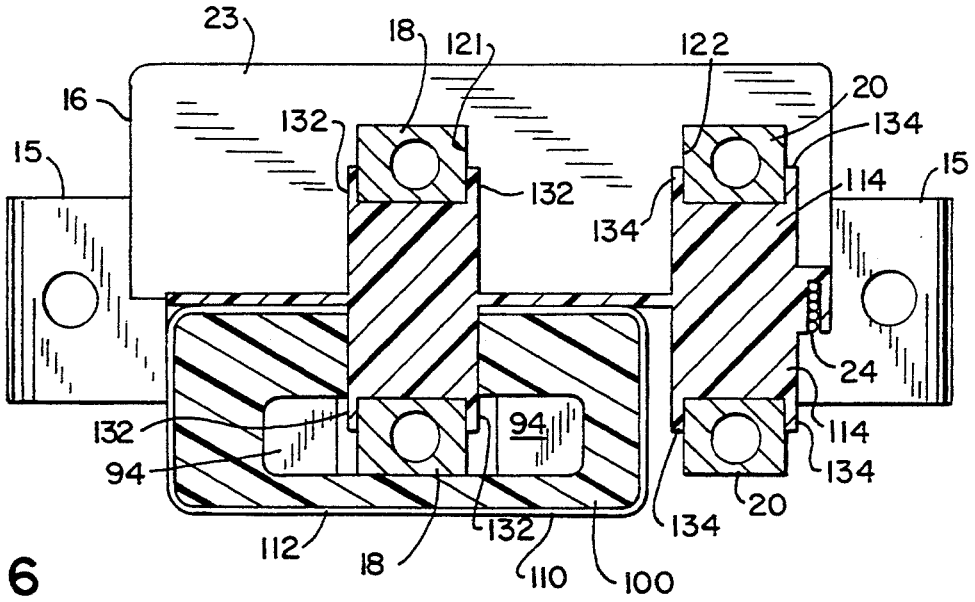
FIG. 6 is a cross sectional view along line 6—6 of FIG. 2.

The upper portion of the shell 16 has two rectangular recesses 121 and 122 extending through a vertical wall 22, which recesses receive the primary and secondary terminals 18 and 20, respectively, as also shown in FIG. 6 where one shell 14 has been removed. The recesses are closely toleranced and tapered slightly inward so that terminals 18 and 20 are press-fit into the recesses when the housing shells 14 and 16 are clamped together during the riveting process. Specifically, recess 121 rigidly holds the primary terminal 18 to absolutely prevent movement of the integral stationary contact 19 which would negate contact wear allowance between opening and closing contacts 82 and 86, respectively. Because the stationary contact 19 is rigidly held in place, a smaller size solenoid 30 can be utilized to move the contactor 72 than would be required if movement of the stationary contact 19 had to be accommodated.

FIG. 5 also shows a blind aperture 124 in the shell 16 for receiving one of the actuator trunions 67. Notches 128 near the bottom of the shell 16 receive and capture the mounting brackets 15 on each side of the housing 12.

Figure 7:
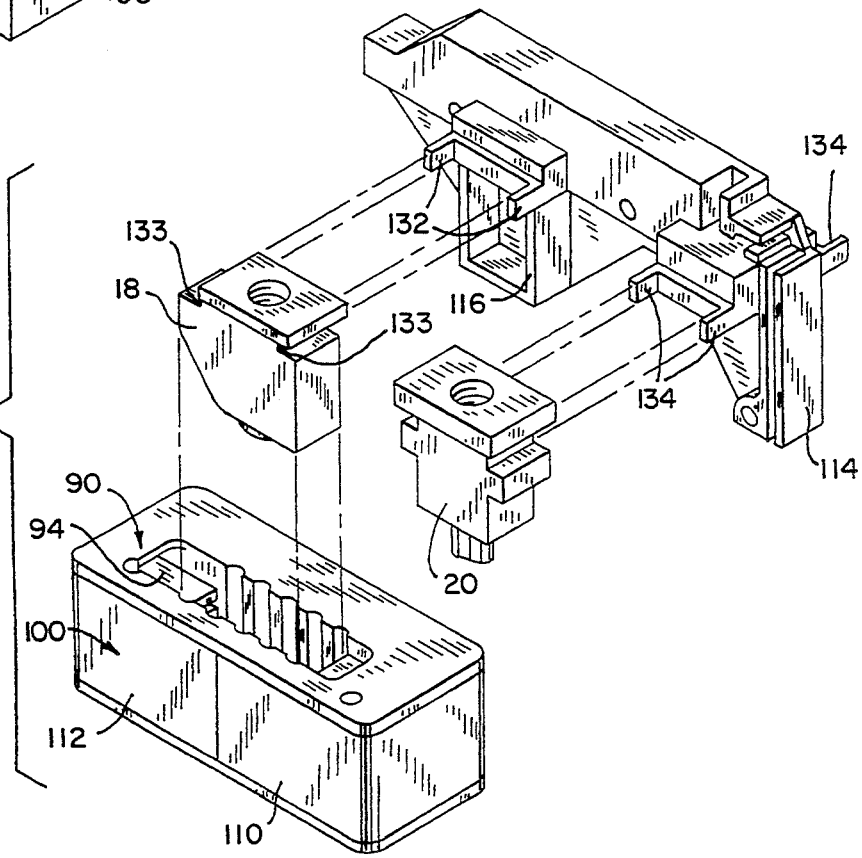
FIG. 7 is an exploded view of a spine plate and components that nest with the spine plate.

After the components are placed into one of the shells, the two shells 14 and 16 are brought together with a plastic spine plate 114 separating the upper portion of the shells adjacent the arc chute assemblies 90 as shown in FIGS. 3 and 6. The spine plate 114 has a hollow rectangular projection 116 extending from each major side surface and into a cavity between the permanent magnets 102 and 104 in the combination of the arc chute and magnet assemblies. The projection 116, shown in detail in FIG. 7, accurately positions that combination which also is held in place by the shell elements that define cavity 127.

A pair of parallel tabs 132 project from each side of the spine plate 114 above the rectangular projection 132. The tabs 132 fit into notches 133 on opposite sides of the primary terminals 18 to firmly hold those terminals within recesses 121 in each shell 14 and 16. Another pair of tabs 134 project in parallel from each side of the spine plate 114 to firmly hold the secondary terminals 20 within recesses 122 in shells 14 and 16. Portions of the spine plate 114 between each pair of tabs 132 and 134 compress the respective terminals 18 and 20 into the shell recesses 121 and 122 so that the terminals are rigidly held in place and properly located when the switching apparatus 10 is riveted together. The spine plate 114 also provides an internal insulating barrier between the two electrical poles of the switching apparatus 10 and a barrier between the two magnetic arc chute assemblies 90 in the upper portion of the housing 12.

When the direct current conducts from the secondary terminal 20 to the primary terminal 18 in the assembled switching apparatus 10 (as indicated by the arrow above contactor 72 in FIG. 2) and the switch begins to open, the current produces a magnetic field which assists arc movement between contacts 82 and 86 into the left arc extinguishing chamber 95 of assembly 90, where the arc is split among the plates 94. The permanent magnet structures 100 create a magnetic field within each arc extinguishing chamber as shown by the curved dashed lines in the lower chamber in FIG. 3. This magnetic field also directs the arc into the extinguishing chamber 95 and toward the side walls so that the arc does not strike the end walls, in addition to stabilizing the arcs and facilitating rapid arc voltage build-up that results in rapid off switching of the current. Because shells 14 and 16 enclose the arc chute assemblies 90 flames, smoke and other arc by-products do not escape into the environment of the switching apparatus 10.

When the current through the contactor is conducting in the opposite direction, that is, from the primary terminal 18 to the secondary terminal 20, the arc between the contacts 82 and 86 is moved in the opposite direction toward the right arc extinguishing chamber 97 which has only three plates 94. Because the magnitude of the regeneration voltage is a differential voltage significantly less than the source voltage used to drive the motor, fewer arc splitter plates are required in this portion of the right arc extinguishing chamber 97.

We claim:

1. A direct current switching apparatus comprising:

a housing formed by first and second shells each having an open side with the open side of said first shell abutting the open side of said second shell;

first and second stationary contacts with said first stationary contact held in the first shell and said second stationary contact held in the second shell;

an actuator of insulating material coupled to said first and second shells to pivot between first and second positions;

a first movable contact member attached in the first shell to said actuator, said first movable contact member touching said first stationary contact when said actuator is in the first position and being remote from said first stationary contact when said actuator is in the second position;

a second movable contact member attached in the second shell to said actuator, said second movable contact member touching said second stationary contact when said actuator is in the first position and being remote from said second stationary contact when said actuator is in the second position;

a solenoid located within said first and second shells and having an armature connected to said actuator for producing movement between the first and second positions;

a first pair of arc extinguishing chambers within said first shell and spaced apart on opposite sides of the first stationary contact;

a second pair of arc extinguishing chambers within said second shell and spaced apart on opposite sides of the second stationary contact; and a spine plate between said first and second shells and separating said first and second stationary contacts, said spine plate pressing said first and second stationary contacts and said first and second pairs of arc extinguishing chambers into the first and second shells to firmly position those stationary contacts and arc extinguishing chambers.

2. The direct current switching apparatus as recited in claim 1 wherein said first and second stationary contacts are substantially coplanar with the armature of said solenoid.

3. The direct current switching apparatus as recited in claim 1 wherein said first and second shells each have a recess into which one of said first and second stationary contacts is pressed by said spine plate.

4. The direct current switching apparatus as recited in claim 1 wherein said spine plate has projections which engage and press said first and second stationary contacts into the recesses in said first and second shells.

5. The direct current switching apparatus as recited in claim 1 further comprising a first permanent magnet structure extending around said first pair of arc extinguishing chambers; and a second permanent magnet structure extending around said second pair of arc extinguishing chambers.

6. The direct current switching apparatus as recited in claim 5 wherein each of said first and second permanent magnet structures comprises:

first and second permanent magnets spaced from each other;

a magnetic spreader in contact with said first and second permanent magnets;

a first C-shaped pole piece with a first end in contact with said first permanent magnet and having a second end; and a second C-shaped pole piece with a first end in contact with said second permanent magnet and having a second end in contact with the second end of said first C-shaped pole piece.

7. The direct current switching apparatus as recited in claim 6 wherein each pair of arc extinguishing chambers comprises an elongated enclosure with open ends; separate pluralities of spaced apart arc splitter plates within each open end of the enclosure; and a separate end cap across each open end; wherein each pair of arc extinguishing chambers is within and held together by one of said first and second permanent magnet structures.

8. The direct current switching apparatus as recited in claim 6 wherein said spine plate includes projections which are received between the permanent magnets of said first and second permanent magnet structures.

9. The direct current switching apparatus as recited in claim 6 wherein said magnetic spreader has a surface with recesses in which said first and second permanent magnets are received.

10. The direct current switching apparatus as recited in claim 6 wherein said spine plate is sandwiched between the pole pieces of said first permanent magnet structure and the pole pieces of said second permanent magnet structure.

11. The direct current switching apparatus as recited in claim 6 wherein:

said magnetic spreader has a first interlocking member; and one of said first and second pairs of arc extinguishing chambers has a second interlocking member that engages the first interlocking member.

12. The direct current switching apparatus as recited in claim 1 wherein said first and second movable contact members are pivotally attached to said actuator; and further comprising a spring mechanism which biases said first and second movable Contact members with respect to said actuator.

13. The direct current switching apparatus as recited in claim 12 wherein each of first and second movable contact members pivots about an axis that is different from an axis about which said actuator pivots, so that said first and second movable contact members wipe across said first and second stationary contacts.

14. The direct current switching apparatus as recited in claim 12 further comprising a spring that biases a portion of said actuator away from a wall of said housing.

15. An electric current switching apparatus comprising:

a housing formed by first and second shells each having an aperture and an open side with the open side of said first shell abutting the open side of said second shell;

first and second stationary contacts with said first stationary contact held in the first shell and said second stationary contact held in the second shell;

an actuator of insulating material coupled to said first and second shells to pivot between first and second positions, said actuator including a central portion, a first wall spaced from the central portion to form a first channel therebetween, a second wall spaced from the central portion to form a second channel therebetween, and an arm extending from the central portion, each of said first and second side walls having a trunion projecting therefrom and into the aperture in one of the first and second shells;

a first movable contact member pivotally attached in the first channel to said actuator, said first movable contact member touching said first stationary contact when said actuator is in the first position and being remote from said first stationary contact when said actuator is in the second position;

a second movable contact member pivotally attached in the second channel to said actuator, said second movable contact member touching said second stationary contact when said actuator is in the first position and remote from said second stationary contact when said actuator is in the second position; and a solenoid located within said first and second shells and having an armature connected to the arm of said actuator for producing movement between the first and second positions.

16. The electric current switching apparatus as recited in claim 15 wherein said actuator is pivotally coupled to each one of said shells at points which produce substantially vertical movement of said first and second movable contact members with respect to said first and second stationary contacts and which produce contact movement that is in substantially a common plane with movement of the armature.

17. The electric current switching apparatus as recited in claim 15 further comprising first and second springs each of which biases a different one of said first and second said first and second movable contact members with respect to said actuator.

18. The switching apparatus as recited in claim 17 further comprising a third spring that biases said actuator with respect to said housing.

19. The electric current switching apparatus as recited in claim 15 further comprising a spine plate between said first and second shells and separating said first and second stationary contacts, said spine plate pressing said first and second stationary contacts into the first and second shells to firmly position such those stationary contacts.

20. The electric current switching apparatus as recited in claim 15 further comprising:

a first pair of arc extinguishing chambers within said first shell and spaced apart on opposite sides of the first stationary contact; and a second pair of arc extinguishing chambers within said second shell and spaced apart on opposite sides of the second stationary contact.

21. The electric current switching apparatus as recited in claim 20 wherein each of said first and second movable contact members comprises a contactor arm through which, when the switching apparatus is closed, current conducts in a direction that produces a magnetic field that aids in moving an arc into one of the arc extinguishing chambers.

22. The electric current switching apparatus as recited in claim 21 wherein each contactor arm has a tapered tip that allows arc gases to flow around the contactor arm.

23. The electric current switching apparatus as recited in claim 20 further comprising a first permanent magnet structure extending around said first pair of arc extinguishing chambers; and a second permanent magnet structure extending around said second pair of arc extinguishing chambers.

24. The current switching apparatus as recited in claim wherein each of said permanent magnet structures comprises:

first and second permanent magnets that are spaced apart;

a magnetic spreader in contact with said first and second permanent magnets;

a first C-shaped pole piece having a first end in contact with said first permanent magnet and having a second end; and a second C-shaped pole piece having a first end contacting with said second permanent magnet and having a second end in contact with the second end of said first C-shaped pole piece.

25. An electric current switching apparatus comprising:

a housing formed by box-like first and second shells each having an open side with the open side of said first shell abutting the open side of said second shell;

an electromagnetic driver fixedly captured within said housing and having a movable plunger;

a contact actuator coupled to the plunger and pivotally mounted within said housing with a pivot axis located to one side of plunger movement;

means for biasing said contact actuator and the plunger into a retracted position of the plunger;

an insulating spine disposed between the shells within said housing and dividing a portion of said housing into separate pole chambers, wherein each pole chamber includes:

(a) a movable contact movably attached to said actuator and biased into a given position with respect to said actuator;

(b) first and second terminals mounted in openings in an exterior wall the housing;

(c) a stationary contact integral with said first terminal and aligned with said movable contact;

(d) a conductor connecting said movable contact to said second terminal; and (e) an arc chute assembly disposed around said stationary contact and said movable contact, and providing a magnetic field across a current path between said stationary contact and said movable contact;

wherein the plunger moves in a line that is coplanar with movement of said movable contacts in each pole chamber.

26. The electric current switching apparatus as recited in claim 25 wherein said contact actuator is pivotally coupled to each one of said first and second shells at points which produce substantially vertical movement of each movable contact with respect to an associated stationary contact, and which produce contact movement that is in substantially a common plane with movement of the plunger.

27. The electric current switching apparatus as recited in claim 25 wherein said arc chute assembly comprises:

an elongated enclosure with open ends, spaced apart arc splitter plates within each open end, and a separate end cap across each open end of the enclosure; and a magnet structure including a pair of permanent magnets spaced from each other by a magnetic spreader, and pole pieces in contact with the pair of permanent magnets, wherein said magnet structure extends around said elongated enclosure.

* * * * *

UNITED STATES PATENT AND TRADEMARK OFFICE

CERTIFICATE OF CORRECTION

Patent No. : 5,416,455

Dated : May 16, 1995

Inventor(s) : Moldovan et al.

It is certified that error appears in the above-identified patent and that said Letters Patent is hereby corrected as shown below:

In column 10, line 56, after "claim" insert --23--.

Signed and Sealed this

Eleventh Day of July, 1995

*Attest:*

*Attesting Officer*

BRUCE LEHMAN

*Commissioner of Patents and Trademarks*